US008167487B2

(12) United States Patent
Fuller

(10) Patent No.: US 8,167,487 B2
(45) Date of Patent: May 1, 2012

(54) SECURE ACCESS EASY OPENING TAMPER EVIDENT FEATURE FOR SEALABLE BAGS

(75) Inventor: Scott Anthony Fuller, Oshkosh, WI (US)

(73) Assignee: Milprint, Inc., Oshkosh, WI (US)

( * ) Notice: Subject to any disclaimer, the term of this patent is extended or adjusted under 35 U.S.C. 154(b) by 417 days.

(21) Appl. No.: 12/512,550

(22) Filed: Jul. 30, 2009

(65) Prior Publication Data

US 2011/0026855 A1 Feb. 3, 2011

(51) Int. Cl.

| | |
|---|---|
| ***B65D 33/14*** | (2006.01) |
| ***B65D 33/00*** | (2006.01) |
| ***B65D 33/16*** | (2006.01) |
| ***B65D 30/20*** | (2006.01) |
| ***B31B 1/60*** | (2006.01) |
| ***B31B 1/00*** | (2006.01) |
| ***B65B 61/18*** | (2006.01) |
| ***B65B 3/04*** | (2006.01) |

(52) U.S. Cl. ..... 383/5; 383/207; 383/210; 383/210.1; 383/61.1; 383/120; 493/210; 493/267; 53/412; 53/469

(58) Field of Classification Search .... 383/5, 61.1–61.5, 383/207, 210–211, 120; 53/469, 412; 493/210, 493/267

See application file for complete search history.

(56) References Cited

U.S. PATENT DOCUMENTS

| | | | | |
|---|---|---|---|---|
| 2,161,474 | A * | 6/1939 | Klein | 229/80 |
| 2,560,535 | A | 7/1951 | Allen | |
| 3,510,053 | A | 5/1970 | Focke | |
| 4,791,710 | A * | 12/1988 | Nocek et al. | 24/585.12 |
| 4,964,739 | A * | 10/1990 | Branson et al. | 383/5 |
| 5,174,657 | A | 12/1992 | Peppiatt | |
| 5,725,312 | A | 3/1998 | May | |
| 5,783,266 | A | 7/1998 | Gehrke | |
| 6,003,582 | A | 12/1999 | Blohowiak et al. | |
| 6,004,032 | A * | 12/1999 | Kapperman et al. | 383/5 |
| 6,244,748 | B1 * | 6/2001 | Kasai et al. | 383/203 |
| 6,315,448 | B1 | 11/2001 | Thrall | |
| 6,467,957 | B2 | 10/2002 | Yeager | |
| 6,478,465 | B1 | 11/2002 | Thrall | |
| 6,516,850 | B1 | 2/2003 | Blohowiak et al. | |
| 6,595,690 | B2 * | 7/2003 | Machacek | 383/203 |
| 6,609,827 | B2 * | 8/2003 | Bois et al. | 383/59 |
| 6,659,643 | B2 * | 12/2003 | Plourde et al. | 383/61.2 |
| 6,799,890 | B2 * | 10/2004 | Schneider et al. | 383/210 |
| 6,910,805 | B2 * | 6/2005 | Johnson | 383/61.2 |
| 6,913,387 | B2 | 7/2005 | Strand et al. | |
| 6,991,372 | B2 * | 1/2006 | Cornelisse | 383/64 |
| 7,207,718 | B2 | 4/2007 | Machacek | |

(Continued)

*Primary Examiner* — Jes F Pascua
(74) *Attorney, Agent, or Firm* — Christine E. Parsons; Glenn W. Ohlson

(57) ABSTRACT

This disclosure describes a secure access, easy opening tamper evident feature for sealable bags. The tamper evident feature provides dual zones for tamper-detection and may be sealed within a bag to form a package in such a manner that allows for the filling of product into the package and the handling of the package to be safely made, as the tamper evident feature may be positioned away from deleterious contact with the product. The package may be a combination of the tamper evident feature and a flexible bag. The package may include an easy opening end configuration for secure access inside the bag when the tamper evident feature is exposed and subsequently torn open by an end-user along the dual zones for tamper detection. The package may be formed with bags having side gussets or, alternatively, with folded-closed end. Methods for making and filling such packages are also provided.

54 Claims, 9 Drawing Sheets

U.S. PATENT DOCUMENTS 7,424,796 B2 9/2008 Shepard et al.
2001/0053253 A1* 12/2001 Buchman et al. ..... 383/5
2003/0103689 A1 6/2003 Schneider et al.
2006/0003879 A1* 1/2006 Buchman ..... 493/213

* cited by examiner

SECURE ACCESS EASY OPENING TAMPER EVIDENT FEATURE FOR SEALABLE BAGS

BACKGROUND OF THE INVENTION

The present disclosure relates to a tamper evident feature that provides secure access and easy opening for bags. More particularly, the present disclosure relates to a tamper evident feature at the openable end of a bag. The present disclosure further relates to a secure access, easy opening, tamper evident feature that provides dual rupturable zones of protection for packaging, packaged product and end-users.

BRIEF SUMMARY OF THE INVENTION

According to the present disclosure, a tamper evident feature affords easy rupturable opening by an end-user and is adaptable for use with various bag configurations. In illustrative embodiments, the tamper evident feature affords easy access to product packaged within a bag and is capable of withstanding forces encountered when the bag is being filled with product or during handling, shipping, stocking on shelves and the like.

The tamper evident feature provides the tamper evident function as dual zones (e.g., upper and lower zones) of rupture, making apparent to the end-user whether the bag has been subjected to tampering and thus providing various levels of protection.

Additionally, illustrative embodiments disclose that the tamper evident feature is affixable to a pre-made bag (or other packaging) or to a bag during bag-making steps, introduced either transversely or longitudinally with respect to the machine direction depending upon bag type, bag gusseting, folding, sealing and other features chosen.

Also, the tamper evident feature is capable of providing barrier properties in a sealed package to achieve freshness and cleanliness for products/commodities/comestibles contained within the sealed package.

Another aspect of the disclosure is the ease of use afforded the end-user with minimal instruction.

Additionally, in accordance with the present disclosure, the tamper evident feature is affixable and sealable to a bag to form a sealed (hermetically or otherwise) package for products/commodities/comestibles packaged in the package. An openable seal can be formed above the tamper evident feature for initial opening of the package followed by the end-user rupturing the dual zones of tamper evident protection to expose and dispense the product contained within the bag.

The present disclosure additionally includes a method for making a bag with the tamper evident feature to form a package. Additional aspects of this disclosure provide a method for filling bags of the type that are either bottom-filled or top-filled such that the tamper evident feature is afforded protection, as harmful forces from product being introduced into the bag are deterred.

Additional features of the present disclosure will become apparent to those skilled in the art upon consideration of the illustrative embodiments exemplifying the best mode of carrying out the disclosure as presently perceived.

BRIEF DESCRIPTION OF THE DRAWINGS

The detailed description particularly refers to the accompanied figures in which.

DETAILED DESCRIPTION OF THE INVENTION

Figure 1:
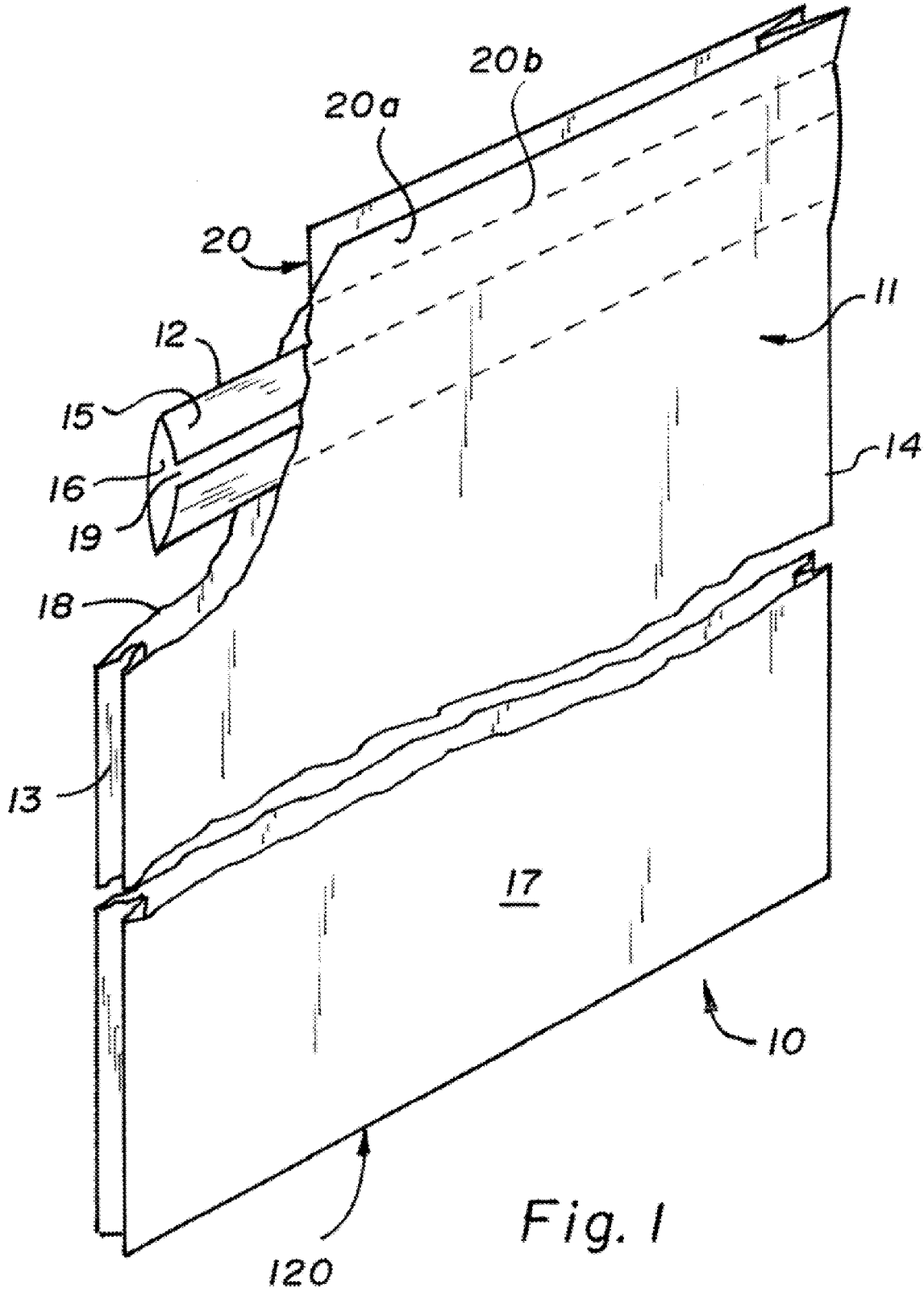
FIG. 1 is a perspective cut-away view of a sealed package formed by the tamper evident feature affixed interiorly adjacent to an end of a sealed bag with side gussets, wherein the tamper evident feature is sealed within the bag at a location below the seal closure at the upper end of the bag, is sealed at two locations to the first panel of the bag and at one location to the second panel of the bag and has a generally C-shaped configuration.

The present disclosure may be susceptible to different embodiments. The present description is to be considered an exemplification of the principles of the disclosure and is not intended to limit the disclosure to the details of construction, arrangements and methods set forth in the following embodiments and/or illustrated in the drawings.

A package 10 is shown in FIG. 1. The package 10 includes a flexible film, pouch-like bag 11 with a tamper evident feature 12 at an upper sealed end of the bag 11. The tamper evident feature 12 provides secure access, easy opening and dual tamper evident zones. The bag 11 is of a type having a first side-gusset 13 and a second side-gusset 14. The tamper evident feature 12 extends between the first side gusset 13 and the second side-gusset 14 and is made of a flexible material having an exterior side 15 and an interior side 16. Both the exterior side 15 and the interior side 6 are sealable. The exterior side 15 may be less resistant to heat sealing than the interior side 16. The tamper evident feature 12 is folded to be generally C-shaped in cross-section, and the exterior side 15 is sealable to the interior surface of the bag 11.

Figure 8:
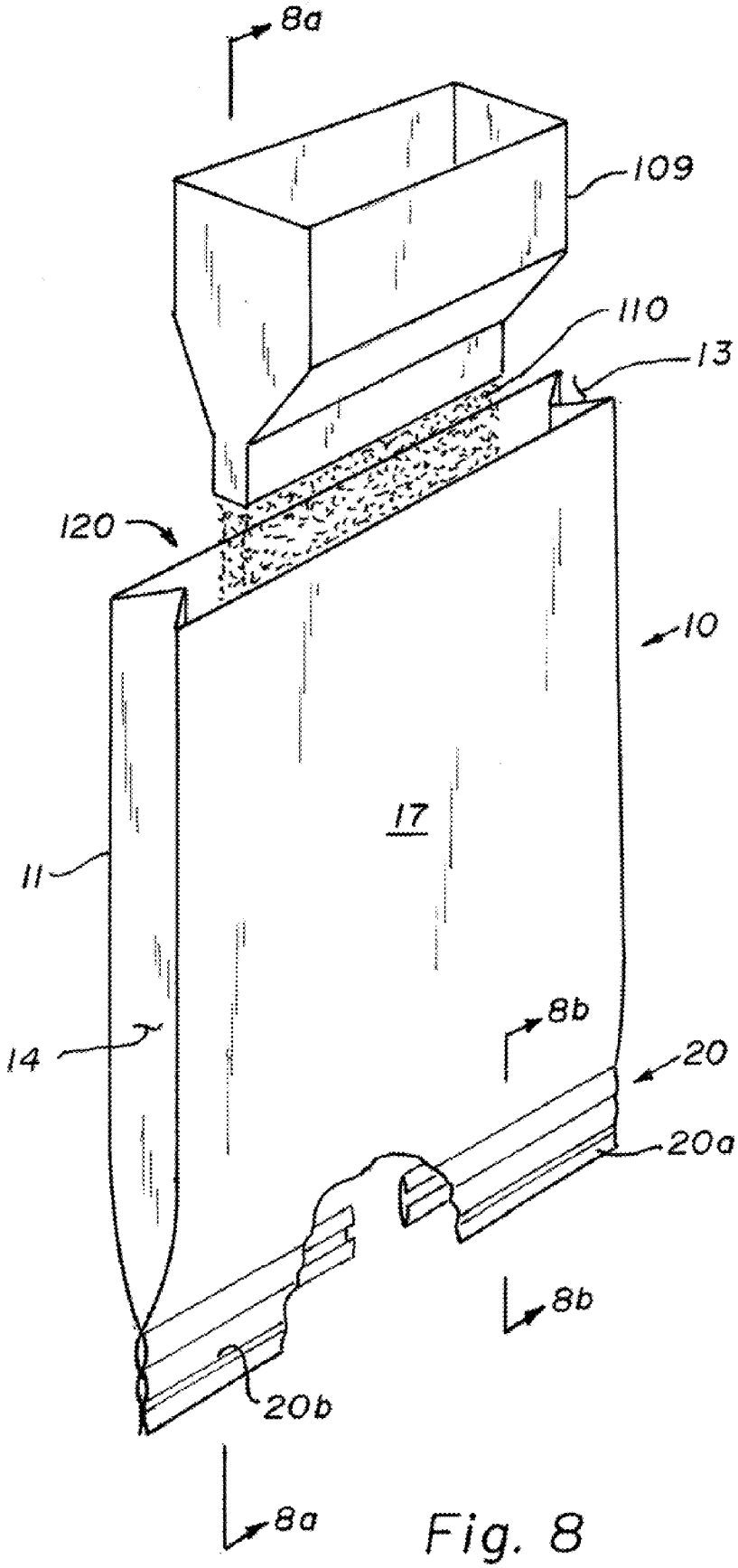
FIG. 8 shows the filling of a package with side gussets, as shown in FIG. 4, wherein the bag is filled in the inverted condition, such that the end of the bag to be subsequently opened by the end-user is upside down; the bottom end of the bag, depicted as an open end, is inverted and shown receiving product from a fill spout device; and, upon filling, this open end of the bag can be sealed.

The bag 11 has a first panel 17 and a second panel 18 joined at the side-gussets 13, 14. The tamper evident feature 12 has a gap 19 in the C-shape positioned such that the gap 19 is positioned against the interior surface of the first panel 17. The package 10 has an upper openable end 20 comprising an upper seal 20*a* adjacent a tear-openable weakened zone 20*b*. The upper seal 20*a* seals together the first panel 17 and the second panel 18 at the upper openable end 20 of the bag 11. The weakened zone 20*b* may be, for example, a rupturable score line or a line of perforations (i.e., a scored line or a perforated line) for the end-user to tear open the upper openable end 20 and expose the tamper evident feature 12. The package 10 encloses product between the first panel 17 and the second panel 18 of the bag 11. Opposite the upper openable end 20, the bag 11 has an open lower end 120, which may be the filling end of the bag 11 that is to be sealed after the package is filled with product, as shown in FIG. 8. The package 10 is adapted for filling with a variety of products, comestibles and commodities, including cat food, dog food, lawn treatment granules, crystallized chemicals, seeds, powders and a wide variety of products of varying sizes, shapes and weights, as are known in the packaging industry.

Figure 2:
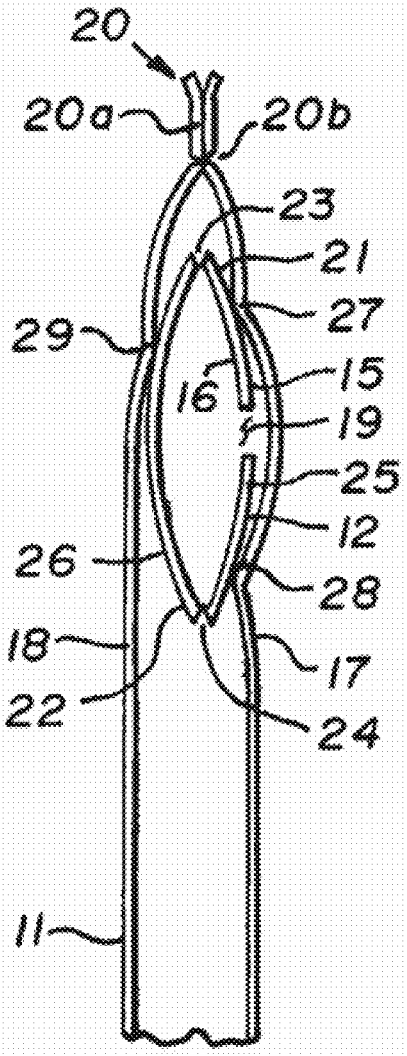
FIG. 2 is a cross-sectional view of the upper portion of the package as shown in FIG. 1 showing upper and lower rupturable zones of the tamper evident feature and the sealing of the feature at two locations to the first panel of the bag and at one location at the opposite side to the second panel of the bag, wherein the upper or top end of the bag is sealed to itself and is capable of being opened by the end-user to expose the tamper evident feature below the upper end of the bag, wherein the tamper evident feature is generally pivotable against the first panel of the bag during filling of a product to protect the tamper evident feature from harmful contact with the product.

FIG. 2 is a cross-sectional view of the upper portion of the package 10 of FIG. 1. The tamper evident feature 12 includes a top fold 21 and a bottom fold 22. The top fold 21 includes a secondary weakened zone 23, and the bottom fold 22 includes a primary weakened zone 24. The weakened zones 23, 24 may be, for example, a perforated line or a scored line (i.e., lines of perforation or scoring). The weakened zones 23, 24 are rupturable by the end-user after the package 10 is opened at the weakened zone 20*b* of the upper openable end 20. The folds 21, 22 are contiguous with a front wall 25 and a back wall 26 of the tamper evident feature 12. The front wall 25 has the gap 19 to create the generally C-shaped appearance. The tamper evident feature 12 provides tamper evidence at the weakened zones 23, 24, which the end-user can observe to be intact or, if subjected to tampering, separated.

The interior surface of the bag 11 is sealable to the exterior side 15 of the tamper evident feature 12 at a first location 27 above the gap 19 (using a first seal line to seal the front wall 25 at the first location 27 to the interior surface of the first panel 17), at a second location 28 below the gap 19 (using a second seal line to seal the front wall 25 at the second location 28 to the interior surface of the first panel 17) and at a third location 29 (using a third seal line to seal the back wall 26 at the third location 29 to the interior surface of the second panel 18). The third location 29 is generally opposite the first location 27. The seal at the third location 29 performs a pivot-like function for the tamper evident feature 12, allowing the bottom fold 22 and the primary weakened zone 24 to pivot and the tamper evident feature 12 to be disposed generally in a lie-flat orientation adjacent the interior surface of the first panel 17 to protect the primary weakened zone 24 during filling of product, as will be further explained in regard to FIGS. 8*a* and 8*b*.

Figure 3:
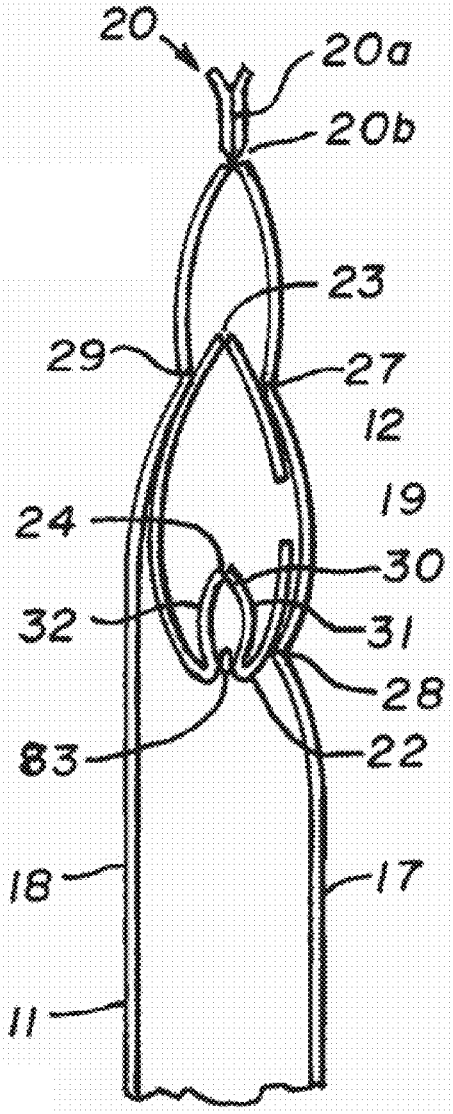
FIG. 3 is a cross-sectional view similar to FIG. 2, wherein the tamper evident feature includes a bottom-gusset for further protection of the lower of the two zones of tamper evident protection, wherein the gusset is releasably tacked dosed to protect the lower zone of rupture during filling of product and wherein the tamper evident feature is generally pivotable against the first panel of the bag during filling of product to protect the tamper evident feature from harmful contact with the product.

With reference to FIG. 3, the tamper evident feature 12 may be formed for a heavier duty application such that the bottom fold 22 includes a gusset 30. The gusset 30 has legs 31, 32 that are releasably tacked together at tacking point 83. A peelable adhesive, a small releasable heat seal or other means known in the art may be used to tack together the legs 31, 32 at tacking point 83. The gusset 30 at the bottom fold 22 disposes the primary weakened zone 24 in an upward direction from the tacking point 83 to further protect the primary weakened zone 24 from harmful contact with the product being filled into the package 10 or during handling, storing and transporting of the filled (or empty) package 10.

Figure 4:
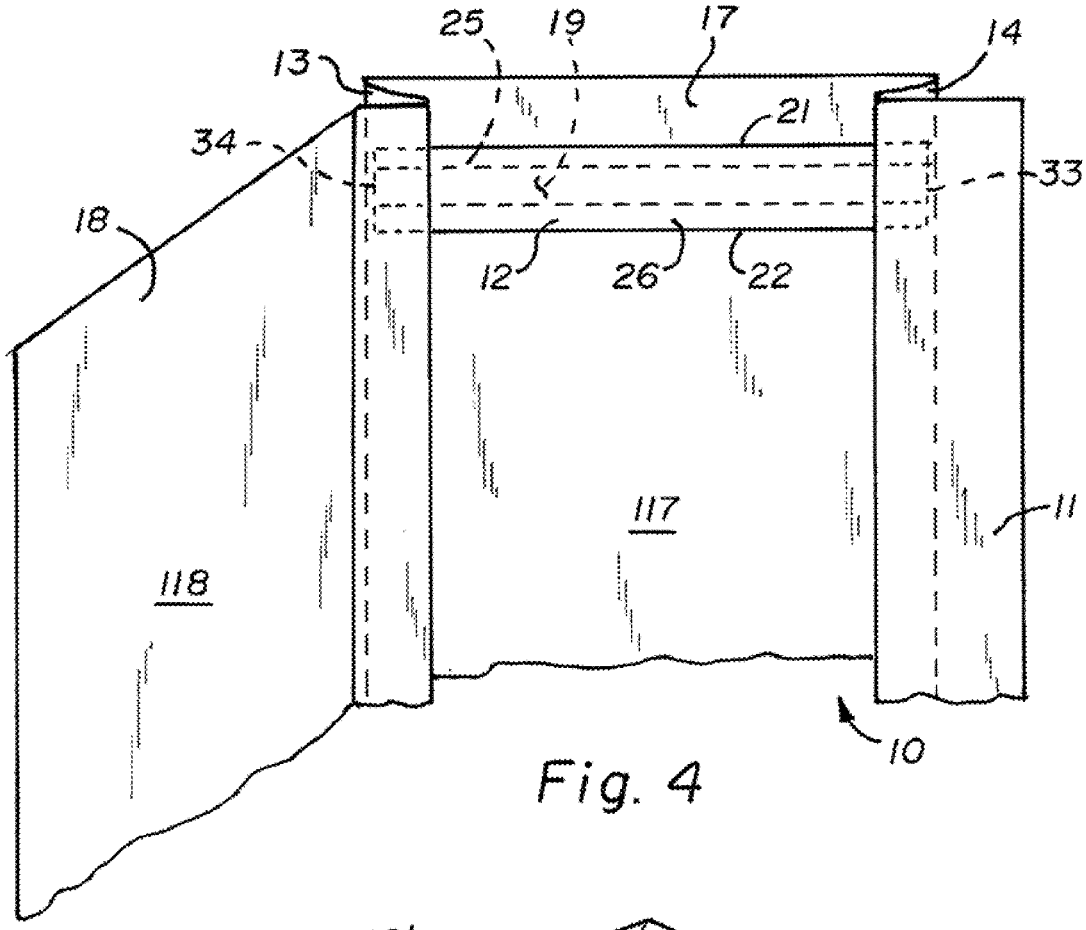
FIG. 4 is a perspective view of the package of FIG. 1 wherein the second panel is illustrated in a swung-open position exposing the interior of the package and showing the tamper evident feature sealed at two locations to the interior of the first panel, whereupon during manufacture of the package the second panel of the bag is moved to be sealed along a vertical side portion of the bag and wherein the tamper evident feature and the second panel are sealed together along one linear third sealing location as shown in FIGS. 2 and 3.

FIG. 4 is a perspective view of the package 10 having the second panel 18 pivoted outwardly to expose the interior of the bag 11 and showing a first interior surface 117 (of the first panel 17) and a second interior surface 118 (of the second panel 18). The tamper evident feature 12 extends between the first side gusset 13 and the second side gusset 14. The front wall 25 is positioned and sealed to the first interior surface 117 of the first panel 17. The front wall 25 of the tamper evident feature 12 also has opposite ends 33, 34, which are sealed to the first interior surface 117 between the side-gussets 13, 14 during the manufacturing of the package 10.

The tamper evident feature 12 in co-operation with the first seal line at the first location 27 at the first interior surface 117, the second seal line at the second location 28 at the first interior surface 117 and the third seal line at the third location 29 at the second interior surface 118 (along with the seals for the opposite ends of the front wall 25, as discussed above) creates a sealed (hermetic or otherwise) barrier between the upper openable end 20 of the bag 11 and the interior portion of the bag 11 between the first panel 17 and the second panel 18 below the tamper evident feature 12. Thus, access to the interior of the bag 11 of the package 10 is accomplished by the end-user tearing open the weakened zones 23, 24 in the tamper evident feature 12.

Figure 5:
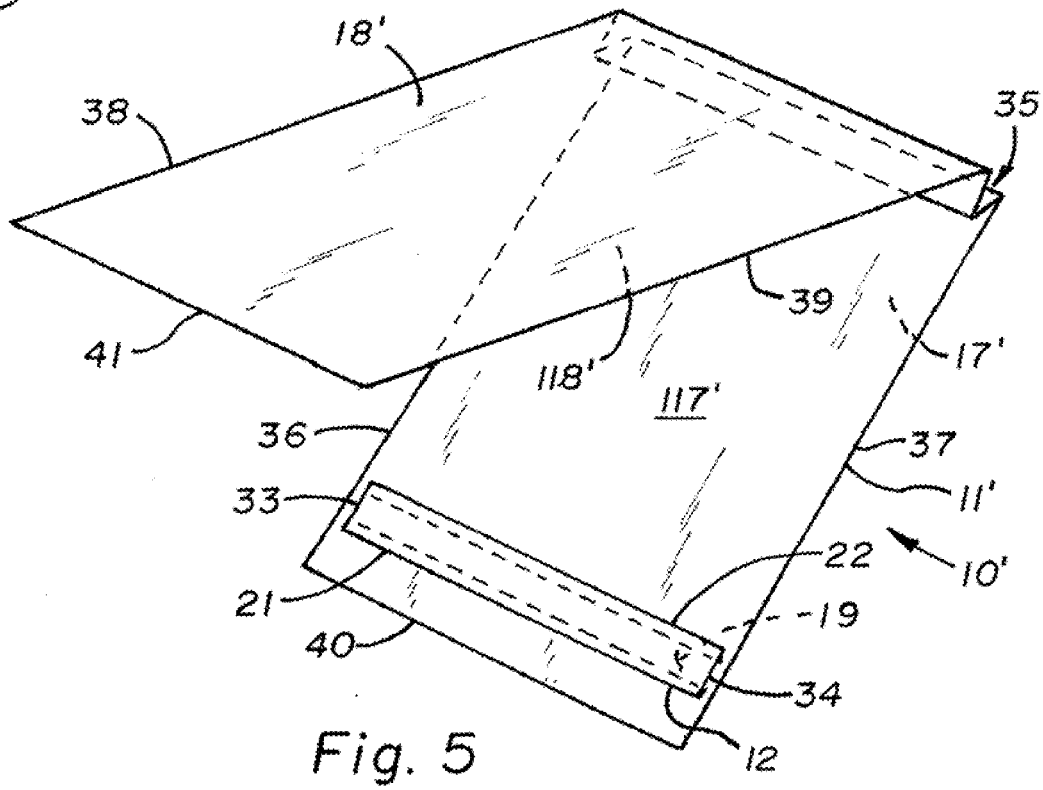
FIG. 5 is a perspective view of a package with the tamper evident feature included in a folded-closed end bag (e.g., a bottom-gusseted bag) showing the first and second panels of the bag pivoted around the bottom-gusset for purposes of illustration.

FIG. 5 is a perspective view of a package 10' formed by the combination of a bag 11' and the tamper evident feature 12. The tamper evident feature 12 is structurally the same as described in FIGS. 1-4. In FIG. 5, the bag 11' is provided with a lower folded-closed end 35, which is exemplified here as a bottom-gusset. The lower folded-closed end 35 joins together a first panel 17' and a second panel 18' of the bag 11'. The lower folded-closed end 35 may alternatively have other folded configurations, such as a V-fold bag, as known in the industry.

Unlike the side-gussets 13, 14 shown in FIGS. 1 and 4, the first panel 17' of bag 11' has a first side edge 36 and a second side edge 37; and, similarly, the second panel 18' has a first side edge 38 and a second side edge 39. During bag-forming, the final configuration for the bag 11' is accomplished by sealing the first edge 36 of the first panel 17' to the first edge 38 of the second panel 18' and the second edge 37 of the first panel 17' to the second edge 39 of the second panel 18'. Upper edges 40 and 41 of the bag 11' are not sealed, as at upper seal 20*a* shown in FIG. 1, until after the package 10' is filled with product. Likewise the tamper evident feature 12 is not sealed to the second interior surface 118' of the second panel 18' at the third location 29, as shown in FIGS. 2 and 3, until after the package 10' has been filled with product, as will be further understood in reference to FIGS. 9 and 9*a*.

Figure 6:
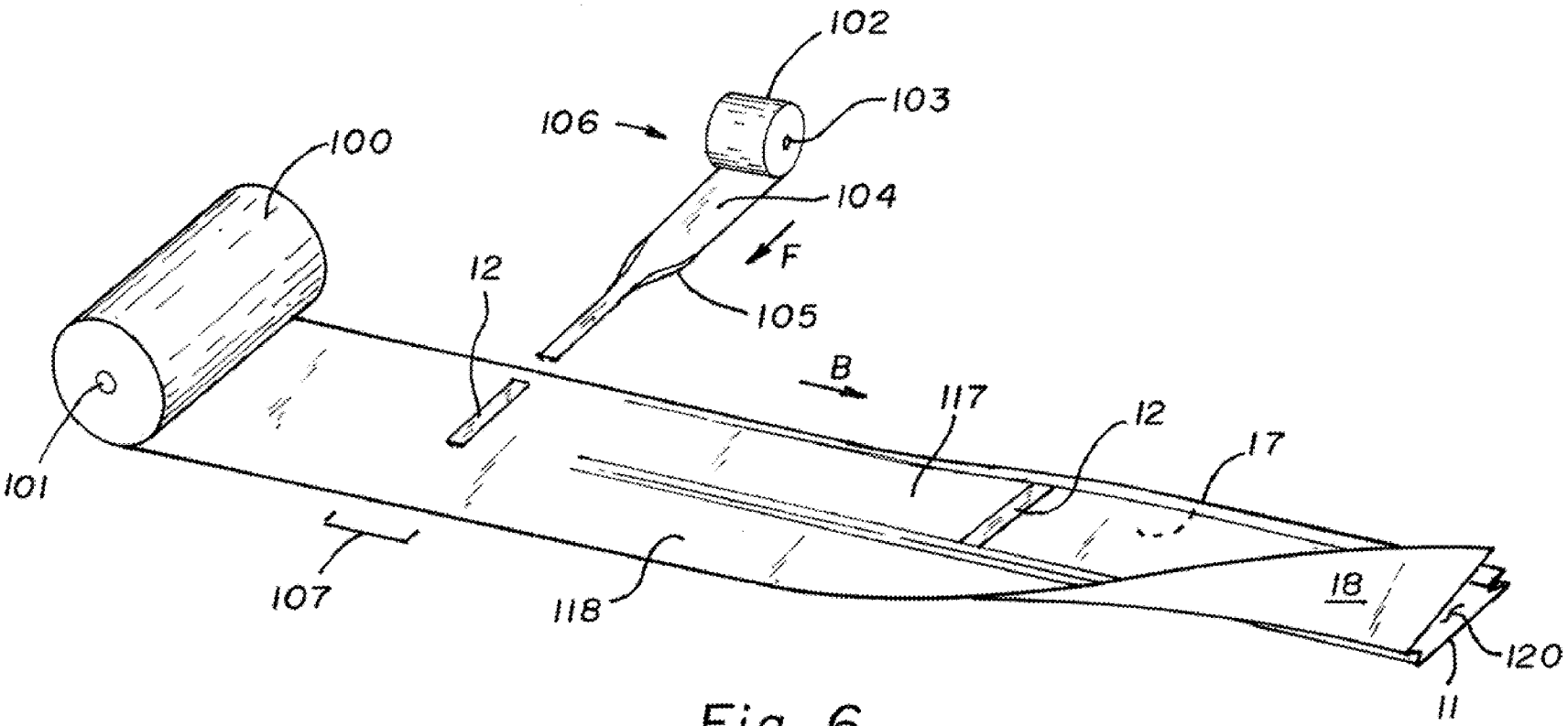
FIG. 6 is a schematic illustration of the making of a package by forming bag film into a pouch-like bag and attaching the tamper evident feature in a transverse direction to the bag-making line for a bag with side gussets, as shown in FIG. 4, whereupon following attachment of the tamper evident feature, the tamper evident feature is sealed to the interior of the bag generally at a location adjacent to a sealed upper end of the ultimately formed package.
Figure 7:
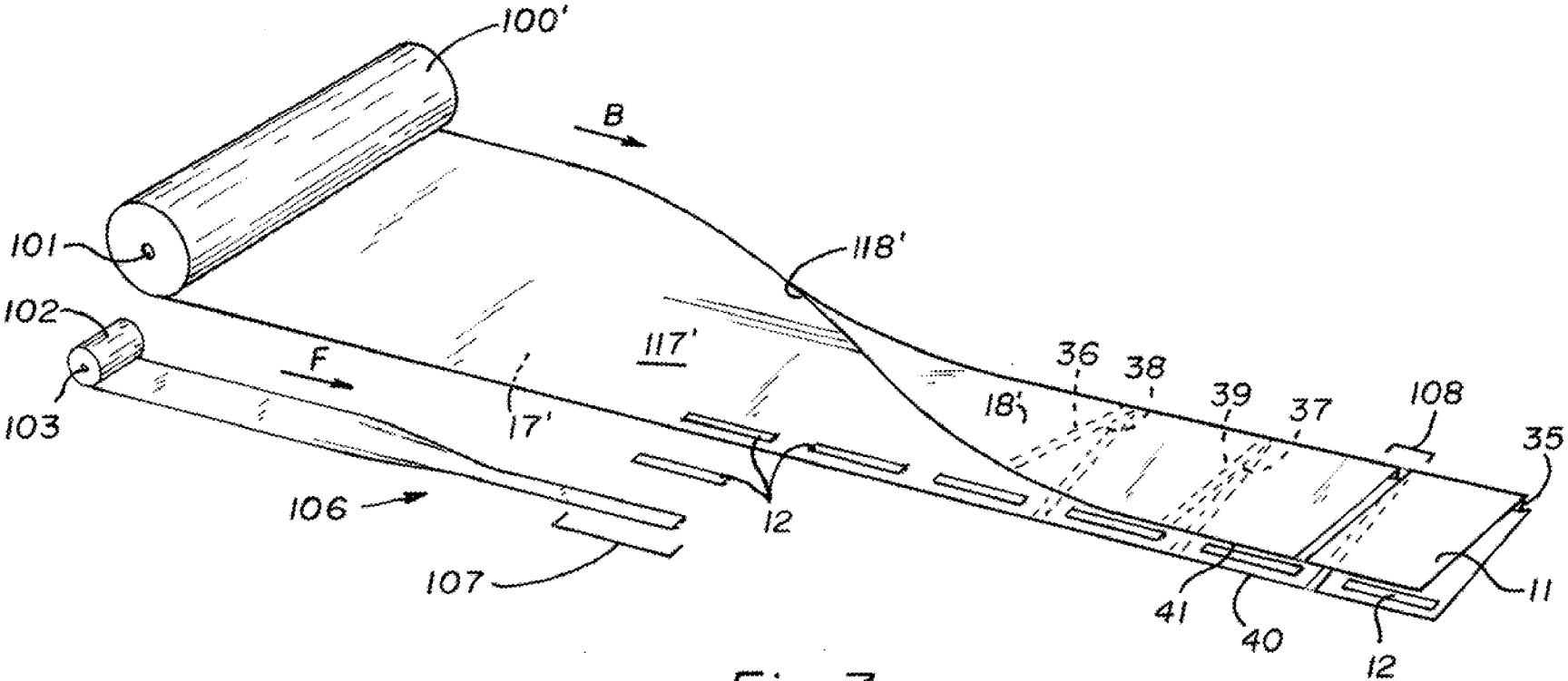
FIG. 7 is a schematic illustration of the making of a package showing the introduction and attachment of the tamper evident feature to a folded-closed end bag, such as a bottom-gusseted bag, wherein for this illustrative embodiment, the tamper evident feature is introduced and affixed to the bag in the machine (i.e., longitudinal) direction of the bag-making line.

With reference to FIG. 6, there is schematically illustrated the making of a package 10 having the side-gussets 13, 14 for the bag 11, as shown in FIG. 1. With reference to FIG. 7, there is schematically illustrated the making of a package 10' having the lower folded-closed end 35 for the bag 11', as shown in FIG. 5. The materials used for making packages 10 and 10' may be the same for both embodiments.

The tamper evident feature 12 may be formed by laminating a less heat-resistant, more readily heat-sealable material to a more heat-resistant, less readily heat-sealable material by means of adhesive lamination or extrusion lamination. Additionally, a co-extruded construction may be employed when there is an inner web that is more heat-resistant and an outer web that is less heat-resistant and more readily heat-sealable at a low temperature initiation. Examples of the more temperature- or heat-resistant web include but are not limited to oriented polyethylene terephthalate (OPET), oriented polypropylene (OPP), high density polyethylene (HDPE), biaxially oriented nylon (BON), paper or combinations of such. This more heat-resistant web may be laminated to a less heat-resistant, more readily heat-sealable sealant film that provides the desired breaking force at the weakened zones 23, 24. The heat-sealable film also has desirable sealing characteristics. The heat-sealable film may be either a monolayer or multilayer structure. The multilayer structure may be co-extruded, extrusion laminated, adhesive laminated or another structure known in the art. Examples of the heat-sealable film include but are not limited to medium density polyethylene (MDPE), low density polyethylene (LDPE), linear low density polyethylene (LLDPE), high density polyethylene (HDPE), nylon, ethylene vinyl acetate (EVA), metallocene, polypropylene (PP), polyester or combinations of such. The heat-sealable material may comprise a co-extruded film that seals at the layer surfaces but separates when peeled apart due to a weakness engineered within the layers of the co-extruded structure. Alternatively to the use of the co-extruded multi-layer sealable material, a monolayered structure may be provided that seals but peels apart because the film is intentionally contaminated with a heat resistant additive, such as but not limited to polybutylene. In either of these alternatives, the heat sealable film functions as a barrier to further strengthen and protect the weakened zones 23, 24.

The weakened zones 23, 24 may be formed, for example, as perforated or scored lines (i.e., lines of perforation or scoring). These lines may be formed by mechanical means, by laser technology or by other means known in the art. In the illustrated embodiments, the tamper evident feature 12 is a laminated structure, and the weakened zones 23, 24 are formed by slitting the more heat-resistant web in the machine direction (i.e., longitudinally) just prior to laminating to the less heat-resistant, more readily heat-sealable web. This results in a score line that allows easy breakage of the tamper evident feature 12 along the score line but maintains the capability of sealing (hermetically or otherwise) and creating a barrier to the interior of the bags 11, 11'. Alternatively, as a mechanical variation, the more heat-resistant web of the tamper evident feature 12 may be perforated, instead of slit. Perforation provides resistance to breakage and breaching of the tamper resistant feature 12 by a heavier product during filling, handling, transport and the like.

The materials used for the tamper evident feature 12 preferably have dead-fold characteristics, namely the ability of the material to hold a folded configuration so that once folded it does not resume its previous shape. With such characteristics, the material used for the tamper evident feature 12 permits the tamper evident feature 12 to lie flat against the first interior surface 117, 117', further protecting the weakened zones 23, 24.

The materials utilized for the pouch-like bags 11, 11' of FIGS. 4 and 5 may be the same materials utilized for the tamper evident feature 12. These materials are flexible and sealable, as known in the bag-making industry. The material for the bags 11, 11' may be any commercially available laminated or non-laminated type known in the flexible packaging arts. The interior surfaces 117, 118 of the bag 11 and the interior surfaces 117', 118' of the bag 11' may be the more readily heat-sealable surfaces. Exterior surfaces of the panels 17, 18 of the bag 11 and the panels 17', 18' of the bag 11', may be less readily heat-sealable than the interior surfaces and may be adapted for receiving printing, labeling, advertising, indicia and the like. The materials for the web to be formed into the pouch-like configuration for the bags 11 and 11' may be laminated, co-extruded, monolayered or other structures known in the art and may be capable of being interiorly sealable at first interior surfaces 117, 117' and second interior surfaces 118, 118'.

All the various seals included in the packages 10, 10' may be formed by various methods including but not limited to heat seal, weld seal, ultrasonic seal, adhesive seal or a combination of such seals. Heat seals may be formed by a hot bar sealer. In using a hot bar sealer, adjacent polymeric layers are held together by opposing sealer jaws, of which at least one is heated, to cause the adjacent polymeric layers to fusion bond by application of heat and pressure across the area to be sealed. Although specific seal conditions vary depending upon thickness, package materials, package configuration, sealing equipment and other variables, a suitable seal using typical equipment known in the art may be achieved with a seal time from about 0.5 seconds to about ten seconds using an upper jaw seal temperature of from about 110° C. to about 250° C., a lower jaw seal temperature of from about 20° C. to about 100° C. and a seal pressure of from about 30 pounds force per square inch to about 150 pounds force per square inch. In one embodiment, a seal time of about 0.5 seconds with an upper jaw seal temperature of at least about 120° C. and a seal pressure of about 40 pounds force per square inch may be employed; in this embodiment, the lower jaw seal is at ambient temperature. Heat seals may also be formed by an impulse sealer. An impulse seal is formed by application of heat and pressure using opposing bars similar to that of the hot bar sealer except that at least one of the bars has a covered wire or ribbon through which electric current is passed for a brief time period to cause the adjacent layers to fusion bond.

The tamper evident feature 12 may be applied (e.g., sealed) to a bag or other packaging configuration after the bag is made (i.e., applied to a pre-made bag) or may be applied to a bag during the bag-making process. FIGS. 6 and 7 illustrate the application of the tamper evident feature 12 to a bag during the bag-making process.

With reference to FIG. 6, a first film web 100 of material for the bag 11 is rolled and mounted on a first unwind device 101, as generally employed in the flexible packaging industry. A second film web 102 of material for the tamper evident feature 12 is rolled and mounted on a second unwind device 103, also of the type known in the flexible packaging industry.

As generally shown at former and application 106, the second film web 102 unwinds at the second unwind device 103 with, for example, the more heat-resistant side 104 in the upward direction and the more readily heat-sealable side 105 at the opposite side. The second film web 102 is then C-folded by a standard C-fold unit along the weakened zones 23, 24 to form the generally C-shape, as shown in FIGS. 2 and 3. For the embodiment of FIG. 3, the method of making the package 10, 10' further includes V-plowing a tuck into the second film web 102 along one side (e.g., in the area of the primary weakened zone 24) to form the gusset 30 with legs 31, 32. The legs 31,32 are tacked together at tacking point 83 by application of a peelable adhesive, by spot heat sealing or by other means known in the art to create a releasable tacking for temporarily holding together the legs 31, 32 for protecting the primary weakened zone 24, as shown in FIG. 3. The second film web 102 is then metered to a specific length, cut and staged for application as the tamper evident feature 12 to the first film web 100. In the embodiment of FIG. 6 for making package 10, the unwind device 103 feeds the second film web 102 transversely (shown by arrow F) to the machine direction (shown by arrow B) of the bag-forming machine.

Machinery and apparatus used to form and apply the tamper evident feature 12 are known in the industry. Examples of such machinery and apparatus include but are not limited to C-fold units and apparatus for applying strips to a film web such as those manufactured by Hudson-Sharp Machine Company (Green Bay, Wis.) and those disclosed in U.S. Pat. Nos. 6,516,850 and 6,003,5.82, which are incorporated in this application by this reference. Other equivalent apparatus and machinery are known to those skilled in the art.

The first film web 100 is conveyed or transported to a web stopper section 107 generally in the area where the former and applicator 106 applies the tamper evident feature 12. The advancing first film web 100 is registered at the web stopper section 107 and former and applicator 106 for correct location of the tamper evident feature 12 on each sequential segment of first film web 100 that is conveyed or transported with sealable side up from the first unwind device 101.

Next, the former and applicator 106 places and seals the tamper evident feature 12 to the first interior surface 117 of the first film web 100 at the first location 27 and at the second location 28, as shown in FIGS. 2 and 3. In the final package 10 these seals are to the first panel 17 of the bag 11 at the first interior surface 117. The first film web 100 is formed into a pouch-like configuration for the bag 11 by folding the first film web 100 around the tamper evident feature 12 such that the second panel 18 overlies the tamper evident feature 12. The side-gussets 13, 14 are formed by V-plowing the side edges of the moving first film web 100 in a known standard bag-making procedure.

Spot seals are made to seal the front wall 25 of the tamper evident feature 12 to the first film web 100 at opposite ends 33, 34, as shown in FIG. 4. The tamper evident feature 12 is thereby sealed (hermetically or otherwise) to the first interior surface 117 of the first panel 17. Next, as the first film web 100 moves along, directional seals are made to reinforce the seals made at the first location 27 and the second location 28 at the web stopper section 107.

A single transverse directional seal is then made at the third location 29 to seal the tamper evident feature 12 to the second interior surface 118 of the second panel 18. This seal creates the pivot point for the tamper evident feature 12. Next, the second panel 18 is sealed to the second side-gusset 14, as shown in FIG. 4; and the transverse seal **20*a* is made at the upper end 20 of the bag 11. A weakened zone 20*b* of, for example, perforated or scored lines, may be formed during the bag-making process or before. These lines for the weakened zone 20*b* may be formed by mechanical means, by laser technology or by other means known in the art. The formed sequential packages 10 are then indexed to a cut-off station 108 (see FIG. 7), where each package 10 is cut to a specific length and the individual cut packages 10** are ready for use.

Turning now to FIG. 7, the method of making the package 10' as shown in FIG. 5 is schematically illustrated. In this illustration, a first web film 100' of material for the bag 11' is rolled and mounted on a first unwind device 101 similar to FIG. 6. The second film web 102 is similarly wound on the second unwind device 103, except that it is oriented to be unrolled in the machine direction (i.e., longitudinally), as shown by arrow B, so that it follows the path shown by arrow F (i.e., generally parallel to the machine direction B) for unwinding the first film web 100'. In this embodiment, the first and second panels 17', 18' are transversely folded and then tucked (e.g. V-plowed, as described above) at one end to form the lower folded-closed end 35 (exemplified here as a bottom gusset) in a standard operation known in the bag-making industry. The first film web 100' is fed to the web stopper section 107 and registered to the former and applicator 106. A C-fold unit at the former and applicator 106 forms the C-shaped configuration for the second film web 102. In this embodiment, the individual tamper evident features 12 may be segmented from the second film web 102 and put in registered sections along the moving first film web 100' or may be continuously fed as a non-segmented second film web 102 to be segmented and cut downstream along with the cutting of the first film web 100' for separating each package 10'.

In this embodiment, the tamper evident feature 12 is mounted parallel to the machine direction B and sealed at the first location 27 and the second location 28 parallel to (i.e., longitudinally of) the machine direction B. In the final package 10', the tamper evident feature 12 is sealed (hermetically or otherwise) to the first interior surface 117' of the first panel 17'. The upper edges 40, 41 of the bag 11' are not sealed as at upper seal **20*a* in FIGS. 2 and 3. The weakened zone 20*b* is created, as in the method of FIG. 6, during or before the bag-making process. However, the upper seal 20*a* for sealing upper edges 40, 41 is not made until after the package 10' is filled, as will be further explained in regard to FIG. 9**.

When the tamper evident feature 12 is placed by the former and applicator 106 onto the moving first film web 100', spot seals are made to seal the front wall of the tamper evident feature 12 to the first interior surface 117' at opposite ends 33, 34, as in FIG. 6, sealing (hermetically or otherwise) the tamper evident feature 12 to the first panel 17' of the bag 11'. Transverse sealing is made to seal the first edge 36 of the first panel 17' to the first edge 38 of the second panel 18' and the second edge 37 of the first panel 17' to the second edge 39 of the second panel 18' to form a first sealed side edge and a second sealed side edge of the package 10' such that each sealed side edge extends between the lower folded-closed end 35 and the upper edges 40, 41. A second longitudinal sealing step is made to reinforce the seals at the first location 27 and the second location 28. The individual segments of packages 10' may be severed to form the first sealed side edge and the second sealed side edge for each individual bag 11' when the bag 11' and the tamper evident feature 12 segments are indexed to the cut-off station 108 to form the individual packages 10'.

FIG. 8 is a perspective illustration of the filling of the package 10, of FIGS. 1 and 4. The open lower end 120 as shown in FIG. 1 is inverted for introduction of a fill spout device 109 for dispensing product 110 into the package 10 opposite the upper openable end 20.

Figure 8A:
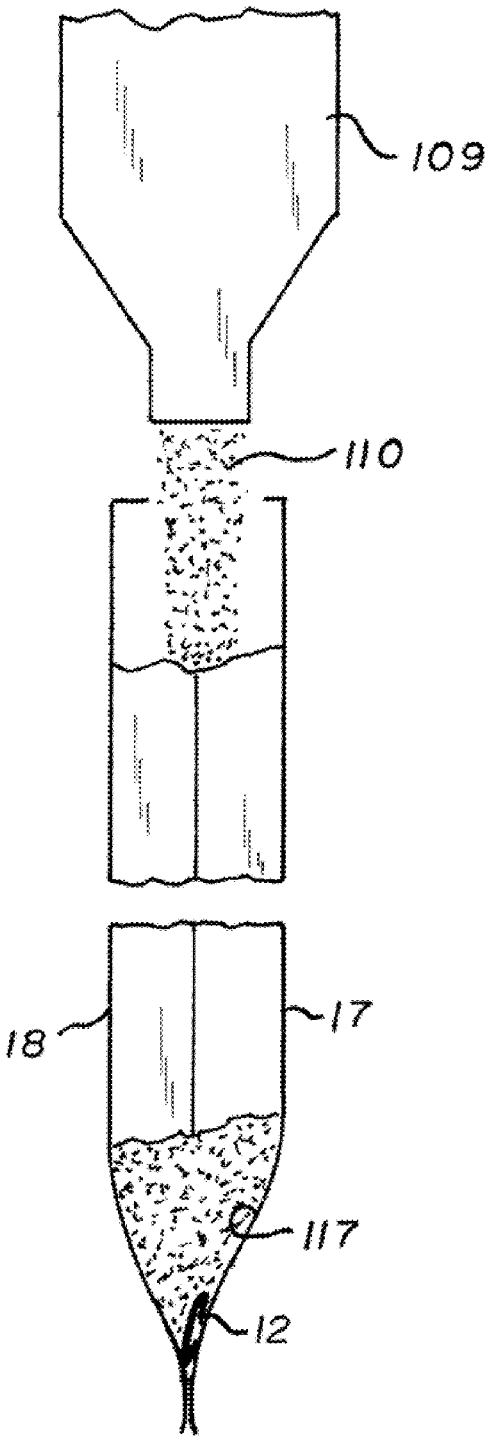
FIG. 8*a* is a cross-sectional view of FIG. 8 taken along lines 8*a*-8*a* in the direction shown by the arrows, illustrating the pivot-action of the tamper evident feature such that the tamper evident feature generally lies flat against one panel of the bag to protect the rupturable weakened zones of the tamper evident feature from harmful contact with the product entering the bag from the fill spout device.
Figure 8B:
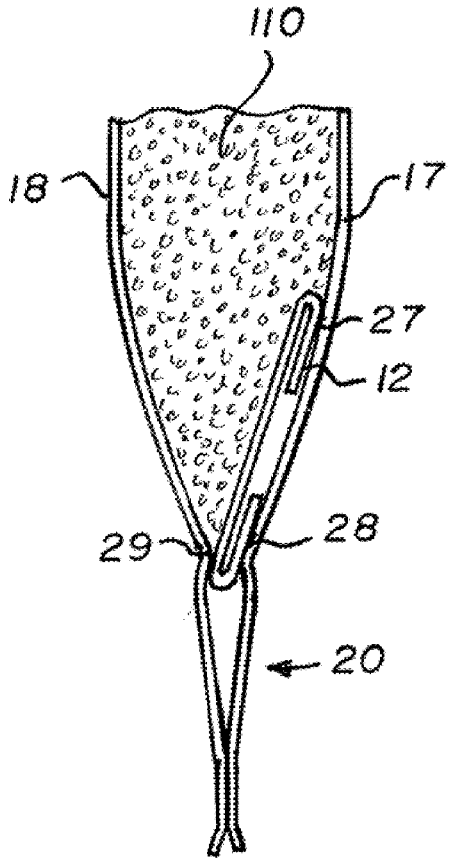
FIG. 8*b* is an enlarged detailed cross-sectional view of the inverted upper end of the bag, as shown in FIG. 8, taken along lines 8*b*-8*b* in the direction shown by the arrows, further depicting the pivot action of the tamper evident feature upon the introduction of product from the fill spout device and additionally illustrating the upper seal adjacent a weakened zone to be subsequently opened by the end-user.

FIG. 8*a* is a cross-sectional view taken along lines 8*a*-8*a* of FIG. 8 illustrating the lay-flat pivot-action of the tamper evident feature 12, such that the tamper evident feature 12 generally lies flat against the first interior surface 117 of the first panel 17. The tamper evident feature 12 utilizes the seal at the third location 29 as a pivot point to safely accommodate the rupturable weakened zones 23, 24 away from harmful contact with product 110, as is more specifically illustrated in the cross-sectional view of FIG. 8*b*. Upon filling the package 10 with product 110, the open lower end 120 is transversely sealed to seal product 110 within the package 10 by sealing the first panel 17 to the second panel 18 between the first side-gussets 13 and the second side-gusset 14.

Figure 9:
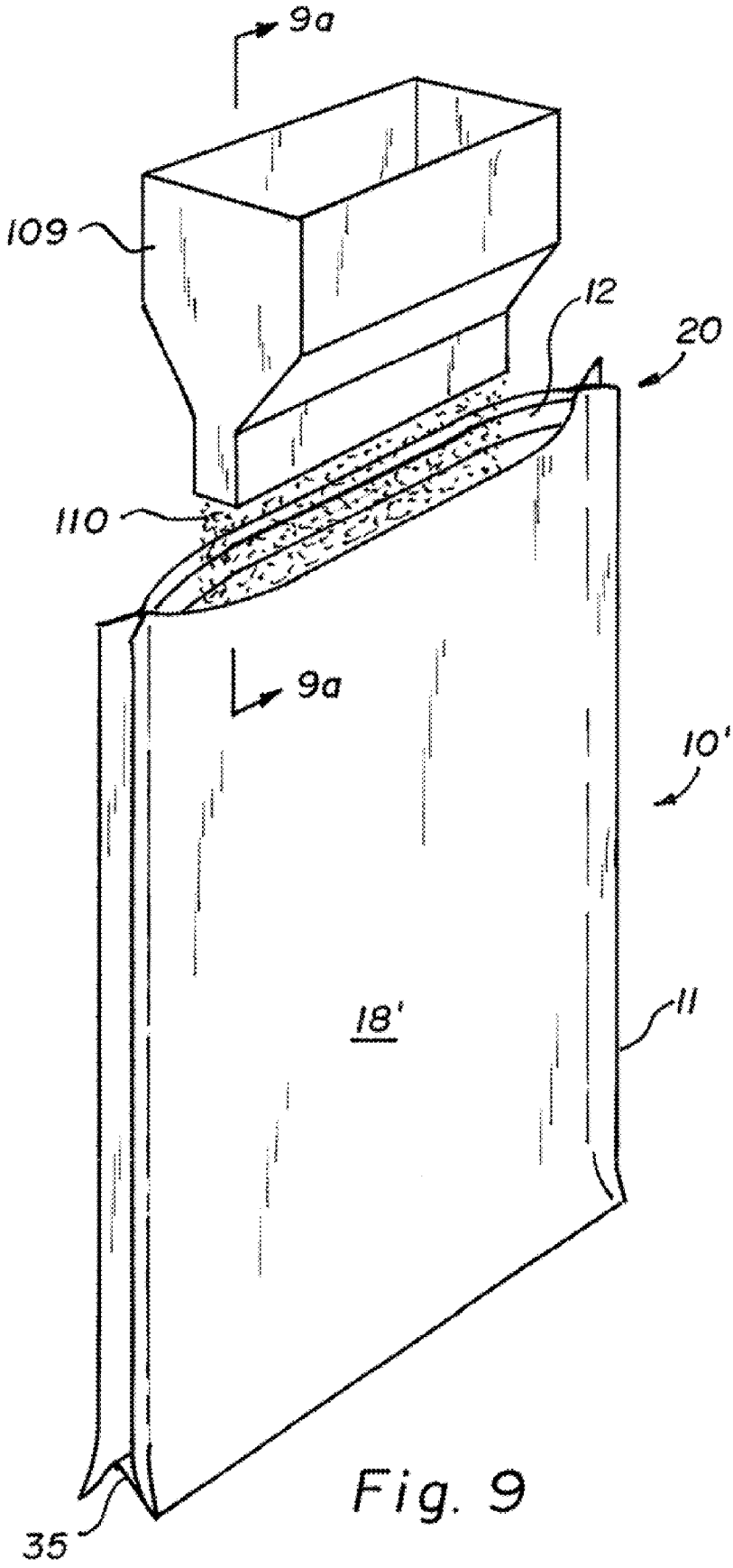
FIG. 9 illustrates the filling of a package with a folded-closed end, as shown in FIG. 5, wherein the fill spout device is inserted at the open upper end of the bag generally adjacent the tamper evident feature, and product is introduced into the interior of the bag past the tamper evident feature.

FIG. 9 is a perspective view of the package 10' of FIG. 5 made in accordance with the method illustrated in FIG. 7. Similar to FIG. 8, a fill spout device 109 introduces product 110 into the package 10'. In this embodiment, the upper openable end 20, opposite the lower folded-closed end 35, is open for filling product 110 and has not yet been sealed at upper seal 20*a*.

Figure 9A:
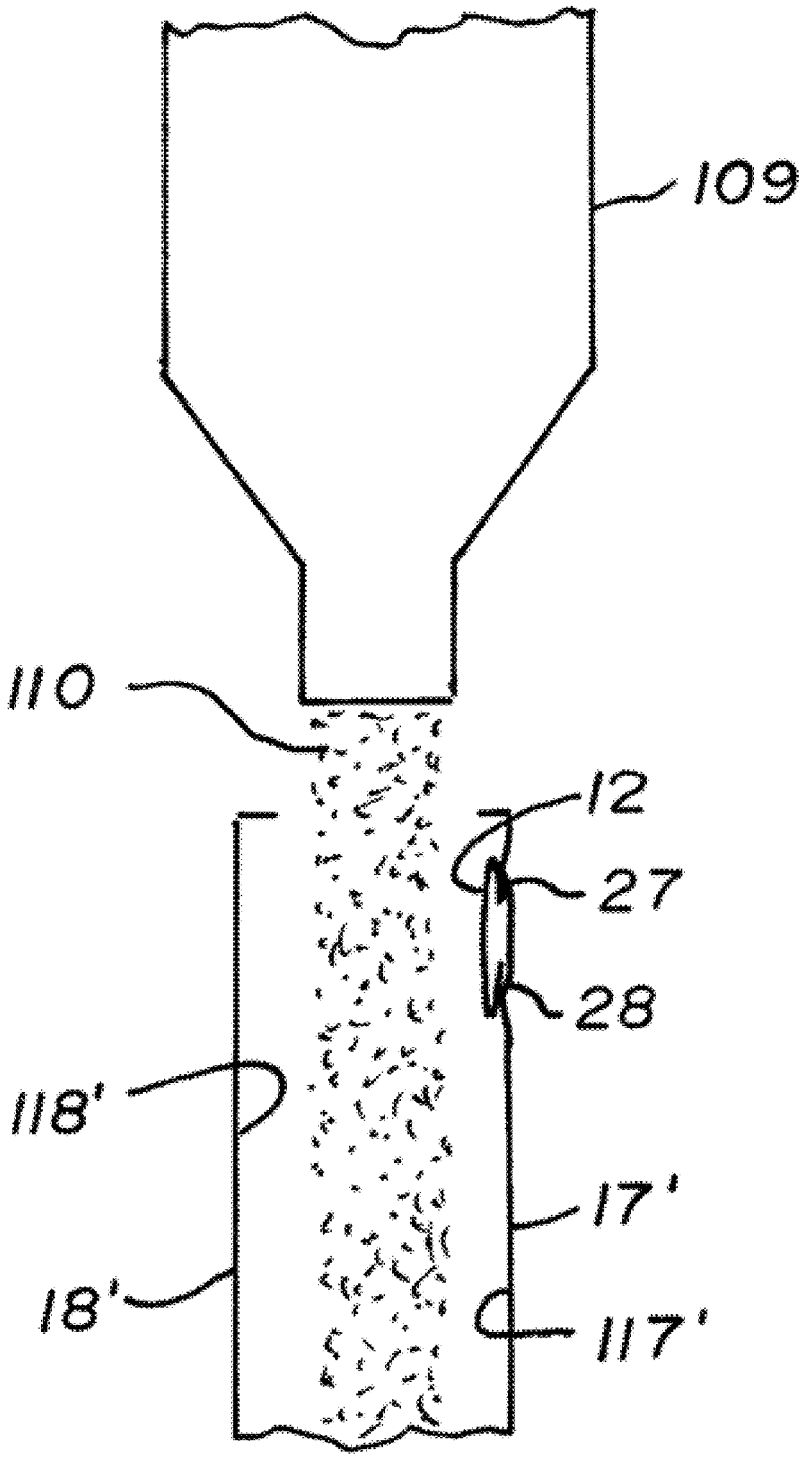
FIG. 9*a* is a partial cross-sectional view of FIG. 9 at the upper end of the package, taken along lines 9*a*-9*a* in the direction shown by the arrows, illustrating the positioning of the fill spout device for dispensing product into the bag past the secure access easy open tamper evident feature, wherein the tamper evident feature is affixed at two seal locations to the first panel of the bag, a third seal affixing the tamper evident feature to the second panel of the bag is not made until completion of the filling of product, and after filling the bag, the bag panels above the tamper evident feature are sealed in a location adjacent an openable weakened zone created for the end-user to subsequently tear-open the package.

FIG. 9*a* is a partial cross-sectional view of FIG. 9 taken along lines 9*a*-9*a* of FIG. 9. The tamper evident feature 12 has not yet been sealed at the third location 29 to the second panel 18' of the bag 11', and the tamper evident feature 12 is held by the seals at the first location 27 and the second location 28 against the first interior surface 117' of the first panel 17'. During filling, product 110 flows safely past the tamper evident feature 12 without any damaging impact. Upon completion of the filling of product 110 into the package 10', upper seal 20*a* may be formed utilizing known bag sealing equipment, and the upper openable end 20 is sealed closed for subsequent opening along weakened zone 20*b* by the end-user. In conjunction with creating the upper seal 20*a*, the seal at the third location 29 is also made to seal the upper openable end 20, as in FIGS. 2 and 3. Thus, FIGS. 2 and 3 illustrate the completed sealing of the upper openable end 20 for both the side-gusseted bag of FIGS. 1 and 4 and the lower folded-closed end bag 10' of FIG. 5.

While embodiments have been illustrated in the figures and described in this disclosure, such illustrations and descriptions are considered exemplary and not restrictive in character. The descriptions of the figures are intended as illustrations of the embodiments of the disclosure and are not intended as having or implying limitation of the disclosure to those embodiments. The illustrated embodiments have been shown and described, and all changes and modifications within the spirit and scope of the figures and the disclosure are desired to be protected.

A plurality of advantages of the present disclosure arises from the various features described. The alternative embodiments of the disclosure may not include all of the features described yet may still benefit from at least some of the advantages of such features. Without undue experimentation, those of ordinary skill in the art may readily devise their own implementations of the disclosure and associated methods that incorporate one or more of the features of the disclosure and that, therefore, fall within the spirit and scope of the disclosure and the claims.

What is claimed is as follows:

1. A package comprising a bag having a first panel and a second panel, wherein the first panel and the second panel are sealed to each other to form a product space therebetween; and a tamper evident feature located between the first panel of the bag and the second panel of the bag, wherein the tamper evident feature is generally C-shaped with a top fold and a bottom fold, wherein the top fold and the bottom fold each has a weakened zone and is each contiguous with a front wall and a back wall of the tamper evident feature and wherein the front wall comprises a gap portion;

wherein the front wall of the tamper evident feature is sealed to the first panel of the bag at a first location above the gap portion of the front wall and at a second location below the gap portion of the front wall and wherein the back wall of the tamper evident feature is sealable to the second panel of the bag at a third location generally opposite the first location;

wherein the bag comprises an upper openable end generally above the top fold of the tamper evident feature and a lower end generally below the bottom fold of the tamper evident feature and wherein the tamper evident feature is located between the upper openable end and the lower end at a location substantially closer to the upper openable end; and wherein the tamper evident feature is arranged with the bag to be directed away from harmful contact with product during filling of product into the product space.

2. The package of claim 1 wherein the bottom fold of the tamper evident feature comprises a gusset.

3. The package of claim 2 wherein the gusset has legs that are releasably tacked together.

4. The package of claim 1 wherein the tamper evident feature comprises a laminated film, a co-extruded film or combinations thereof.

5. The package of claim 1 wherein the lower end of the bag comprises a folded-closed end.

6. The package of claim 5 wherein the folded-closed end comprises a gusset or a V-fold.

7. The package of claim 1 wherein the weakened zone in each of the top fold and the bottom fold comprises a perforated line or a scored line.

8. A package comprising a bag having a first panel and a second panel, wherein the first panel and the second panel are sealed to each other to form a product space therebetween; and a tamper evident feature located between the first panel of the bag and the second panel of the bag, wherein the tamper evident feature is generally C-shaped with a top fold and a bottom fold, wherein the top fold and the bottom fold each has a weakened zone and is each contiguous with a front wall and a back wall of the tamper evident feature and wherein the front wall comprises a gap portion;

wherein the front wall of the tamper evident feature is sealed to the first panel of the bag at a first location above the gap portion of the front wall and at a second location below the gap portion of the front wall and wherein the back wall of the tamper evident feature is sealed to the second panel of the bag at a third location generally opposite the first location;

wherein the bag comprises an upper openable end generally above the top fold of the tamper evident feature and a lower end generally below the bottom fold of the tamper evident feature and wherein the tamper evident feature is located between the upper openable end and the lower end at a location substantially closer to the upper openable end; and wherein the tamper evident feature is arranged with the bag to be directed away from harmful contact with product during filling of product into the product space.

9. The package of claim 8 wherein the sealing of the back wall of the tamper evident feature to the second panel of the bag at the third location comprises a pivot point for the tamper evident feature.

10. The package of claim 8 wherein the bottom fold of the tamper evident feature comprises a gusset.

11. The package of claim 10 wherein the gusset comprises legs that are releasably tacked together.

12. The package of claim 8 wherein the tamper evident feature comprises a laminated film, a co-extruded film or combinations thereof.

13. The package of claim 8 wherein the lower end is a sealable open end.

14. The package of claim 8 wherein the weakened zone in each of the top fold and the bottom fold comprises a perforated line or a scored line.

15. The package of claim 8 wherein the bag comprises side-gussets.

16. A combination of a bag and a tamper evident feature affixed to the bag wherein the combination comprises a bag comprising a first panel comprising a sealable film and a second panel comprising a sealable film, wherein the first panel and the second panel are sealed to each other to form a product space therein and wherein the bag comprises an open upper openable end and an opposite closed lower end; and a tamper evident feature affixed to the interior of the bag at a location substantially closer to the open upper openable end than to the opposite closed lower end, wherein the tamper evident feature comprises a sealable film and has a front wall and a back wall and wherein the front wall comprises a gap portion;

wherein the front wall of the tamper evident feature is sealed to the first panel of the bag at a first location above the gap portion and at a second location below the gap portion; wherein the back wall of the tamper evident feature is sealable to the second panel of the bag at a third location generally opposite the first location;

wherein the tamper evident feature comprises a primary weakened zone at a lower end and a secondary weakened zone at an upper end, wherein the secondary weakened zone is below the open upper openable end of the bag;

wherein the tamper evident feature is capable of lying substantially flat against the first panel of the bag during filling of product into the product space through the open upper openable end of the bag to protect the primary weakened zone.

17. The combination of claim 16 wherein the open upper openable end is sealed and the secondary weakened zone and the primary weakened zone provide tamper evidence that is visible after opening the sealed open upper openable end, whereby access to the product space is achievable by rupturing the secondary weakened zone and the primary weakened zone.

18. The combination of claim 16 wherein the back wall of the tamper evident feature is sealed to the second panel of the bag at the third location.

19. The combination of claim 16 wherein the lower end of the tamper evident feature comprises a gusset.

20. The combination of claim 19 wherein the gusset comprises legs that are releasably tacked together.

21. The combination of claim 16 wherein the tamper evident feature comprises a laminated film, a co-extruded film or combinations thereof.

22. The combination of claim 16 wherein the opposite closed lower end comprises a folded-closed end.

23. The combination of claim 22 wherein the folded-closed end comprises a gusset or a V-fold.

24. The combination of claim 16 wherein the primary weakened zone and the secondary weakened zone each comprises a perforated line or a scored line.

25. A combination of a bag and a tamper evident feature affixed to the bag wherein the combination comprises a bag comprising a first panel comprising a sealable film and a second panel comprising a sealable film, wherein the first panel and the second panel are sealed to each other to form a product space therein and wherein the bag comprises an upper seal and an opposite open lower end; and a tamper evident feature affixed to the interior of the bag at a location substantially closer to the upper seal than to the opposite open lower end, wherein the tamper evident feature comprises a sealable film and has a front wall and a back wall and wherein the front wall comprises a gap portion;

wherein the front wall of the tamper evident feature is sealed to the first panel of the bag at a first location above the gap portion and at a second location below the gap portion; wherein the back wall of the tamper evident feature is sealed to the second panel of the bag at a third location generally opposite the first location;

wherein the tamper evident feature comprises a primary weakened zone at a lower end and a secondary weakened zone at an upper end, wherein the secondary weakened zone is below the upper seal of the bag;

wherein the tamper evident feature is capable of lying substantially flat against the first panel of the bag during filling of product into the product space through the open lower end of the bag to protect the primary weakened zone.

26. The combination of claim 25 wherein the open lower end is sealed and the secondary weakened zone and the primary weakened zone provide tamper evidence that is visible after opening the upper seal, whereby access to the product space is achievable by rupturing the secondary weakened zone and the primary weakened zone.

27. The combination of claim 25 wherein the sealing of the back wall of the tamper evident feature to the second panel of the bag at the third location comprises a pivot point for the tamper evident feature.

28. The combination of claim 25 wherein the bottom fold of the tamper evident feature comprises a gusset.

29. The combination of claim 28 wherein the gusset comprises legs that are releasably tacked together.

30. The combination of claim 25 wherein the tamper evident feature comprises a laminated film, a co-extruded film or combinations thereof.

31. The package of claim 25 wherein the primary weakened zone and the secondary weakened zone each comprises a perforated line or a scored line.

32. The package of claim 25 wherein the bag comprises side-gussets.

33. A tamper evident feature comprising a front wall comprising a gap portion and a contiguous back wall, wherein the front wall and the back wall are integrally joined at a top fold and a bottom fold to define an elongated C-shape in cross section, wherein the top fold and the bottom fold each has a weakened zone, wherein the front wall of the tamper evident feature is capable of being sealed to a flexible package at a first location above the gap portion and a second location below the gap portion, and wherein the back wall of the tamper evident feature is capable of being sealed to the flexible package at a third location generally opposite the first location;

wherein the tamper evident feature is capable of forming a sealed chamber when sealed to the flexible package at the first location, the second location and the third location;

wherein the tamper evident feature is capable of providing an end-user with visible tamper evidence at the weakened zones; and wherein the tamper evident feature is sufficiently flexible to lie flat against an interior side of the flexible package, thereby protecting the weakened zone in the bottom fold from harmful contact with product during filling of product into the flexible package.

34. The tamper evident feature of claim 33 wherein the bottom fold comprises a gusset.

35. The tamper evident feature of claim 34 wherein the gusset comprises legs that are releasably tacked together.

36. The tamper evident feature of claim 33 wherein the tamper evident feature comprises a layer of a heat-sealable material and a layer of a heat-resistant material.

37. The tamper evident feature of claim 36 wherein the layer of the heat-sealable material comprises a laminated film, a co-extruded film or combinations thereof.

38. The tamper evident feature of claim 36 wherein the layer of the heat-resistant material comprises a laminated film, a co-extruded film or combinations thereof.

39. The tamper evident feature of claim 33 wherein the weakened zone in each of the top fold and the bottom fold comprises a perforated line or a scored line.

40. The tamper evident feature of claim 33 wherein the top fold and the bottom fold each has dead-fold characteristics.

41. A method of making a package with a tamper evident feature wherein the method comprises a. providing a first film web having a sealable side;

b. providing a second film web having a sealable side and parallel weakened zones longitudinal to the second film web;

c. unwinding the first film web longitudinally to a bag-making line;

d. unwinding the second film web generally longitudinally to the bag-making line;

e. transporting the first film web to a web-stopper section with the sealable side of the first film web facing upward;

f. transporting the second film web to the web-stopper section with the sealable side of the second film web facing downward;

g. folding the first film web to form a pouch with a bottom side comprising a first panel with a first edge and a second edge, a top side comprising a second panel with a first edge and a second edge, an interior surface comprising the sealable side of the first film web, and a folded-closed end;

h. folding the second film web at the parallel weakened zones to form a generally C-shape with the sealable side of the second film web comprising an exterior surface of the C-shape, wherein the C-shape has a front wall with a gap portion, opposite ends and a contiguous back wall;

i. sealing the exterior surface of the C-shaped second film web to the sealable side of the first panel of the first film web with a first seal line at a first location above the gap portion and a second seal line at a second location below the gap portion;

j. spot sealing the sealable side of the first panel of the first film web to the opposite ends of the exterior surface of the front wall of the C-shaped second film web;

k. sealing the first edge of the first panel of the pouch to the first edge of the second panel of the pouch and sealing the second edge of the first panel of the pouch to the second edge of the second panel of the pouch to form a first sealed side edge and a second sealed side edge;

l. applying reinforcing seals at the first seal line and the second seal line of the C-shaped second film web; and m. indexing the bag with the C-shaped second film web reinforcingly sealed to the interior surface to a cut-off station to cut the bag at the first sealed side edge and the second sealed side edge, thereby forming an individual package.

42. The method of claim 41 further comprising metering the C-shaped second film web to a specific length, cutting the specific length of the C-shaped second film web and transporting the specific length to the sealable side of the first film web prior to sealing the C-shaped second film web to the first film web.

43. The method of claim 41 further comprising transporting the C-shape second film web as a continuous strip to the sealable side of the first film web prior to sealing the C-shaped second film web to the first film web and cutting a specific length of the C-shaped second film web with the bag at the cut-off station.

44. The method of claim 41 further comprising V-plowing the C-shaped second film web at one of the weakened zones to form a gusset with legs.

45. The method of claim 44 further comprising releasably tacking together the legs of the gusset.

46. The method of claim 41 further comprising V-plowing the folded-closed end to form a gusset.

47. The method of claim 41 further comprising sealing the exterior surface of the C-shaped second film web to the sealable side of the second panel of the first film web with a third seal line at a third location generally opposite the first location.

48. A method of making a package with a tamper evident feature wherein the method comprises a. providing a first film web having a sealable side;

b. providing a second film web having a sealable side and parallel weakened zones longitudinal to the second film web;

c. unwinding the first film web longitudinally to a bag-making line;

d. unwinding the second film web generally transversely to the bag-making line;

e. transporting the first film web to a web-stopper section with the sealable side of the first film web facing upward;

f. transporting the second film web to the web-stopper section with the sealable side of the second film web facing downward;

g. folding the second film web at the parallel weakened zones to form a generally C-shape with the sealable side of the second film web comprising an exterior surface of the C-shape, wherein the C-shape has a front wall with a gap portion, opposite ends and a contiguous back wall;

h. metering the C-shaped second film web to a specific length, cutting the specific length of the C-shaped second film web and transporting the specific length to the sealable side of the first film web;

i. sealing the exterior surface of the C-shaped second film web to the sealable side of the first film web with a first seal line at a first location above the gap portion and a second seal line at a second location below the gap portion;

j. folding the first film web to form a pouch with a bottom side comprising a first panel, a top side comprising a second panel, an interior surface comprising the sealable surface of the first film web, a folded-closed side edge, an opposite side edge, an upper end and a lower end, wherein the C-shaped second film web is sealed to the first panel and is overlaid by the second panel;

k. spot sealing the sealable side of the first panel of the first film web to the opposite ends of the exterior surface of the front wall of the C-shaped second film web;

l. applying reinforcing seals at the first seal line and the second seal line of the C-shaped second film web;

m. sealing the exterior surface of the C-shaped second film web to the sealable side of the second panel of the first film web with a third seal line at a third location generally opposite the first location;

n. sealing the first panel to the second panel at the opposite side edge of the pouch and sealing the first panel to the second panel at the upper end of the pouch to form a bag with a sealed upper end and an open lower end; and o. indexing the bag with the C-shaped second film web reinforcingly sealed to the interior surface to a cut-off station to cut the bag at the sealed upper end and the open lower end, thereby forming an individual package.

49. The method of claim 44 further comprising V-plowing the C-shaped second film web at one of the weakened zones to form a gusset with legs.

50. The method of claim 49 further comprising releasably tacking together the legs of the gusset.

51. The method of claim 48 further comprising V-plowing the folded-closed side edge and the opposite side edge of the pouch to form a gusset at each side edge.

52. The method of claim 48 further comprising forming a tear-openable weakened zone in the sealed upper end.

53. A method of filling a package with product wherein the method comprises a. providing a package comprising a bag having an upper openable end, a lower folded-closed end, opposite side edges, a first panel, a second panel and a tamper evident feature, wherein the tamper evident feature is generally C-shaped with an upper and a lower opposing arm of the C-shape each sealed to an interior surface of the first panel of the bag and with opposing ends of the tamper evident feature sealed to the interior surface of the first panel of the bag at the opposite side edges of the bag and wherein the tamper evident feature has a secondary weakened zone at a top-fold of the C-shape generally adjacent the upper openable end of the bag and a primary weakened zone at a bottom-fold of the C-shape;

b. orienting the upper openable end of the bag in a product receiving alignment to a fill spout device;

c. dispensing product through the upper openable end, whereby product flows past the tamper evident feature into the bag;

d. maintaining the tamper evident feature in a generally lie-flat orientation adjacent the interior surface of the first panel;

e. sealing the tamper evident feature to the second panel at a location generally opposite the seal of the upper arm of the C-shape to the first panel, whereby the tamper evident feature seals product from the upper openable end; and f. sealing the first panel to the second panel at the upper openable end to form a sealed upper end.

54. A method of filling a package with product wherein the method comprises a. providing a package comprising a bag having an sealed upper openable end, an open lower end, opposite side gussets, a first panel, a second panel and a tamper evident feature, wherein the tamper evident feature is generally C-shaped with an upper and a lower opposing arm of the C-shape each sealed to an interior surface of the first panel of the bag, with an upper portion of a back surface of the C-shape sealed to an interior surface of the second panel of the bag at a location generally opposite the seal of the upper arm of the C-shape to the first panel, and with opposing ends of the tamper evident feature sealed to the interior surface of the first panel of the bag at the opposite side gussets of the bag and wherein the tamper evident feature has a secondary weakened zone at a top-fold of the C-shape generally adjacent the sealed upper openable end of the bag and a primary weakened zone at a bottom-fold of the C-shape;

b. orienting the open lower end of the bag in a product receiving alignment to a fill spout device;

c. dispensing product through the open lower end;

d. maintaining the tamper evident feature in a generally lie-flat orientation adjacent the interior surface of the first panel, whereby the primary weakened zone is protected from rupturable contact with dispensing product; and f. sealing the first panel to the second panel at the open lower end to form a sealed lower end.

* * * * *